US011623791B2

(12) United States Patent
Cheng

(10) Patent No.: US 11,623,791 B2
(45) Date of Patent: Apr. 11, 2023

(54) CONTAINER LID AND CONTAINER

(71) Applicant: ZHEJIANG HAODA SCIENCE & TECHNOLOGY CO., LTD, Jinhua (CN)

(72) Inventor: Haojun Cheng, Jinhua (CN)

(73) Assignee: ZHEJIANG HAODA SCIENCE & TECHNOLOGY CO., LTD, Jinhua (CN)

( * ) Notice: Subject to any disclaimer, the term of this patent is extended or adjusted under 35 U.S.C. 154(b) by 142 days.

(21) Appl. No.: 17/172,753

(22) Filed: Feb. 10, 2021

(65) Prior Publication Data

US 2022/0204213 A1 Jun. 30, 2022

(30) Foreign Application Priority Data

Dec. 26, 2020 (CN) ..... 202023202520.0
Jan. 21, 2021 (CN) ..... 202120170139.6

(51) Int. Cl.

| | |
|---|---|
| ***B65D 23/08*** | (2006.01) |
| ***B65D 81/38*** | (2006.01) |
| ***A47G 23/04*** | (2006.01) |
| ***B65D 53/02*** | (2006.01) |
| ***A47G 23/02*** | (2006.01) |
| *B65D 85/30* | (2006.01) |
| *B65D 23/00* | (2006.01) |

(52) U.S. Cl.

CPC ..... *B65D 23/0885* (2013.01); *A47G 23/04* (2013.01); *B65D 53/02* (2013.01); *B65D 81/3881* (2013.01); *A47G 2023/0275* (2013.01); *B65D 23/001* (2013.01); *B65D 85/307* (2013.01)

(58) Field of Classification Search

CPC ..... B65D 21/0885; B65D 81/3881; B65D 81/3876; B65D 85/307; B65D 23/001; B65D 45/32; B65D 45/322; B65D 53/02; A47G 2023/0275; A47G 23/04; F25D 31/007

See application file for complete search history.

(56) References Cited

U.S. PATENT DOCUMENTS 3,285,455 A * 11/1966 Pewitt ..... B65D 81/3879 215/393
4,299,100 A * 11/1981 Crisman ..... B65D 81/3883 220/592.17
4,596,370 A * 6/1986 Adkins ..... B62J 11/04 224/454
4,768,354 A * 9/1988 Barnwell ..... F25D 31/007 62/530
6,481,589 B2 * 11/2002 Blomdahl ..... B65D 41/0485 215/303

(Continued)

*Primary Examiner* — John K Fristoe, Jr.
*Assistant Examiner* — Jennifer Castriotta

(57) ABSTRACT

A container lid and a container are provided. A container lid for sleeving on a drink bottle, comprising an annulus-shaped lid body and a flexible snap ring, and the lid body includes a pilot hole, which penetrates through the lid body; the flexible snap ring comprises an assembly portion and a clamping portion, wherein the assembly portion encircles around an outer surface of the lid body, and a part of the flexible snap ring is extended along a radial direction of the lid body to define the clamping portion, and the clamping portion is capable of penetrating through the pilot hole from the outer surface of the lid body, and abutting against an outer surface of the drink bottle.

14 Claims, 7 Drawing Sheets

(56) References Cited

U.S. PATENT DOCUMENTS

| | | | | |
|---|---|---|---|---|
| 6,516,967 | B2 * | 2/2003 | Duff | F25D 3/08 220/592.16 |
| 7,007,817 | B2 * | 3/2006 | Jochem | B65D 41/0435 215/305 |
| 10,173,827 | B1 * | 1/2019 | Foote, Jr. | A47G 23/0241 |
| 2014/0319158 | A1 * | 10/2014 | Lonsway | B65D 81/3876 220/739 |

* cited by examiner

CONTAINER LID AND CONTAINER

CROSS-REFERENCE TO RELATED APPLICATIONS

This application claims all benefits accruing under 35 U.S.C. § 119 from China Patent Application Nos. 202120170139.6, filed on Jan. 21, 2021, and 202023202520.0, filed on Dec. 26, 2020, in the China National Intellectual Property Administration, the content of which is hereby incorporated by reference.

TECHNICAL FIELD

The present disclosure relates to a container, and in particular, to a container lid and a container.

BACKGROUND

An insulation container is a common commodity in daily life. In the summer, users like cool canned or bottled beverages. Whether it is pouring the drink into a cup, or taking it up to drink, the hand of the user inevitably needs to be in direct contact with the bottle or can. In this way, the body temperature of the user will be directly transmitted to the bottle body, and the hand of the user can get wet or cold. Therefore, the user's experience is not good.

The typical insulation container in the market can accommodate a drink bottle to prevent the occurrence of the aforementioned problems. However, the drink bottle is easy to move or shift around in the conventional insulation container, so that the user's experience of drinking the liquid in the drink bottle accommodated in the insulation container is poor.

SUMMARY

A container lid for sleeving on a drink bottle, includes an annulus-shaped lid body and a flexible snap ring. The lid body includes at least one pilot hole, which penetrates through the lid body, wherein the flexible snap ring includes an assembly portion and at least one clamping portion, wherein the assembly portion encircles around an outer surface of the lid body, and a part of the flexible snap ring extends along a radial direction of a cross section of the lid body to define the at least one clamping portion, and the at least one clamping portion is capable of penetrating through the at least one pilot hole from the outer surface of the lid body, and abutting against an outer surface of the drink bottle.

Furthermore, the at least one clamping portion is flexible, and the at least one clamping portion includes a first surface, the first surface faces a direction that the drink bottle inserts into a container and abuts against the outer surface of the drink bottle when the clamping portion bends.

Furthermore, the first surface includes an antiskid portion, and the antiskid portion is configured for abutting against the outer surface of the drink bottle.

Furthermore, the flexible snap ring includes four clamping portions, and the lid body includes four pilot holes, and the four clamping portions are uniformly disposed on an inner wall of the assembly portion along a circumference of the assembly portion.

Furthermore, a connecting protrusion is configured for connecting the at least one clamping portion with the assembly portion, and the connecting protrusion matches with the at least one pilot hole.

Furthermore, an assembly groove is disposed on the outer surface of the lid body, the assembly portion is inlaid in the assembly groove, and the at least one pilot hole is located at a bottom of the assembly groove.

Furthermore, at least a part of the lid body is extended along the radial direction of the cross section of the lid body and defines a limiting portion, and the limiting portion is disposed on a route along which the at least one clamping portion deforms.

Furthermore, the limiting portion is disposed at a bottom of the lid body.

Furthermore, the limiting portion is annulus-shaped.

The present disclosure further includes a container, including a container body and the container lid covering the container body, wherein the container lid is the container lid illustrated above.

Furthermore, the container body includes a vacuum cup body.

Furthermore, the lid body is configured for covering on the container body.

Furthermore, the outer surface of the assembly portion protrudes out along the radial direction of the cross section of the lid body to define at least one sealing portion, which is configured for abutting against an inner wall of the container body, so that the lid body forms a seal with the container body.

Furthermore, two sealing portions parallel to each other are encircled around the assembly portion.

A container lid in the present disclosure includes a flexible snap ring, which is configured for fixing the drink bottle, so that a container having the container lid can stably accommodate the drink bottle, thereby obviously improving experience of an user.

100 represents a container lid; 10 represents a lid body; 11 represents a top limiting section; 12 represents an assembly section; 121 represents an assembly groove; 122 represents a pilot hole; 123 represents a chamfer; 13 represents a limiting portion; 20 represents a flexible snap ring; 21 represents an assembly portion; 22 represents a clamping portion; 221 represents a first surface; 2211 represents an antiskid portion; 222 represents a connecting protrusion; 23 represents a sealing portion; 200 represents a container body; 300 represents a container; 400 represents a drink bottle.

The present disclosure will be further illustrated in details in conjunction with the callouts, drawings and embodiments hereinafter.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as commonly understood by one of ordinary skill in the art of this application. The terminology used in the specification of the application herein is only for the purpose of describing specific embodiments, and is not intended to limit the application. The term "or/and" as used herein includes any and all combinations of one or more related listed items.

Figure 1:
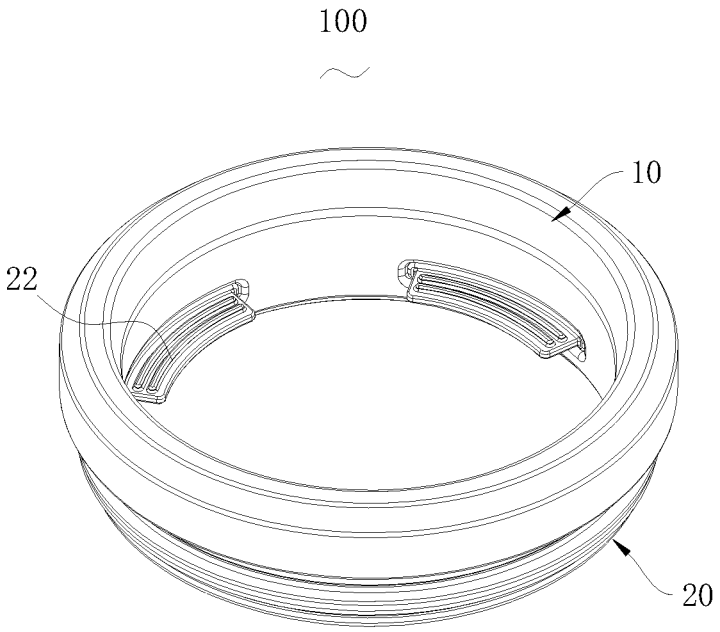
FIG. 1 is a structural schematic view of a container lid of an embodiment of the present disclosure.
Figure 2:
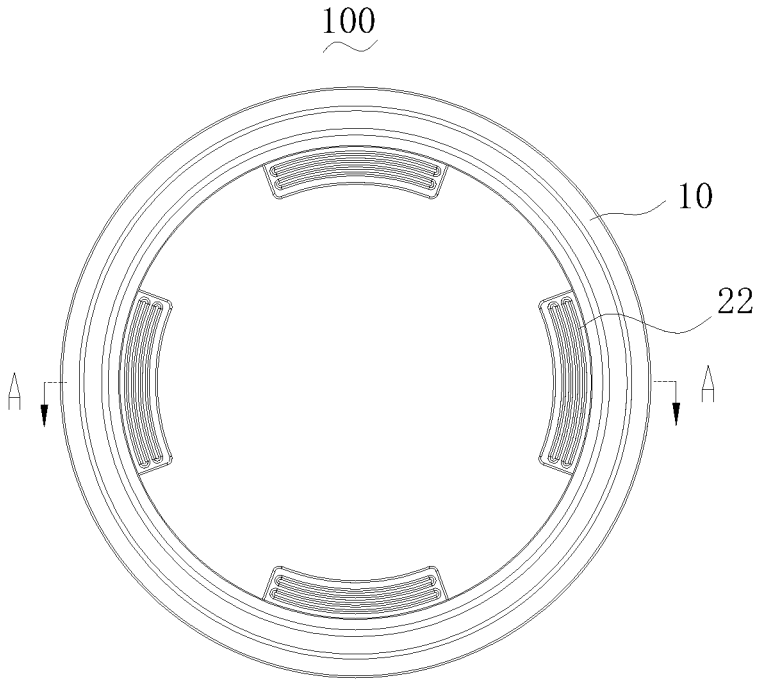
FIG. 2 is a structural schematic view of the container lid in FIG. 1 with another view angle.
Figure 3:
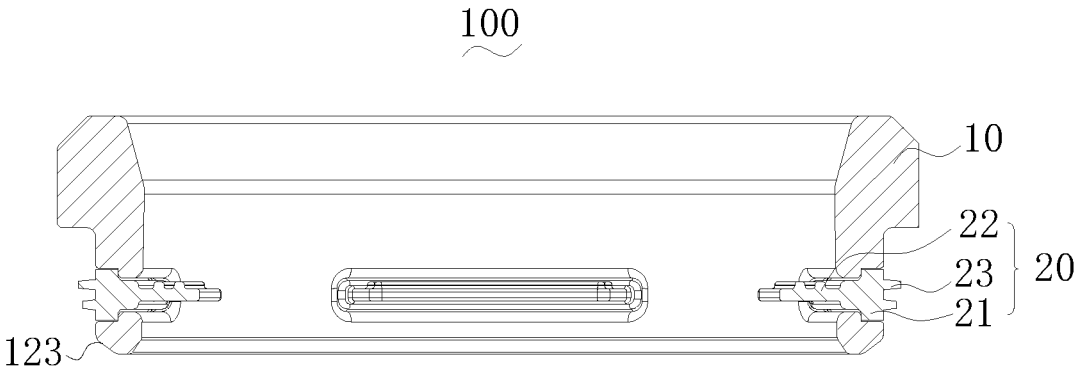
FIG. 3 is a cross-section view of the container lid in FIG. 2 along A-A line.

FIG. 1 is a structural schematic view of a container lid 100 of an embodiment of the present disclosure; FIG. 2 is a structural schematic view of the container lid 100 in FIG. 1 with another view angle; and FIG. 3 is a cross-section view of the container lid 100 in FIG. 2 along A-A line.

The present disclosure includes a container lid 100. The container lid 100 can work together with the container body 200 to accommodate a drink bottle 400. The drink bottle 400 can be any utensil configured for containing a liquid, for example a coke can, a beer bottle, a cup and the like.

The container lid 100 can be disposed on an opening of the container body. When a drink bottle 400 is accommodated in the container body 200, the container lid can be configured for abutting against the drink bottle 400, so as to prevent the drink bottle 400 from shaking in the container body 200. The container lid 100 can include an annulus-shaped lid body 10 and a flexible snap ring 20. The lid body 10 can be connected to the container body 200, and the flexible snap ring 20 can be encircled around an outer surface of the lid body 10. The lid body 10 and the flexible snap ring 20 can work together to make the container lid cover on the opening of the container body 200.

Figure 4:
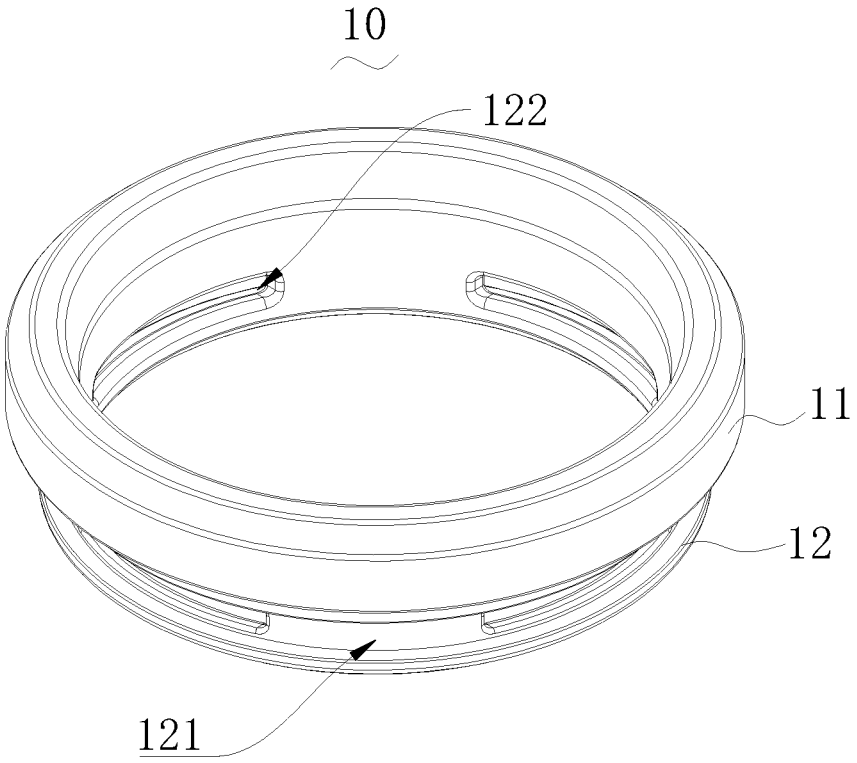
FIG. 4 is a structural schematic view of a lid body of the container lid in FIG. 1.

FIG. 4 is a structural schematic view of a lid body 10 of the container lid 100 in FIG. 1.

The lid body is roughly annulus-shaped. The lid body 10 can include a top limiting section 11 and an assembly section 12, which are disposed along an axial direction of the lid body 10. The top limiting section 11 and the assembly section 12 can be fixed with each other, or can be integrated. A top surface of the lid body 10 can protrude along a radial direction of a cross section of the lid body 10 to define the top limiting section 11. A part of the top limiting section 11 protruding out from the lid body 10 can abut on an outer surface of the container body 200 and define a smooth outer surface of the container 300. The top limiting section 11 can abut against an end surface of the container body 200, so as to make the lid body 10 stably connected to the container body 200.

The assembly section 12 can be configured for protruding into the container body 200, and can work together with an inner wall of the container body 200 to seal the opening of the container body 200. At least one pilot hole 122 can be disposed on the assembly section 12. The pilot hole 122 can penetrate a sidewall of the assembly section 12 along the radial direction of the cross section of the lid body 10. The pilot hole 122 can be configured for assembling a part of the flexible snap ring 20 protruding along the radial direction of the cross section of the lid body 10, so that the part of the flexible snap ring 20 can protrude towards the center of the lid body 10.

Furthermore, an annulus-shaped assembly groove 121 can be disposed on the assembly section 12. The assembly groove 121 can be disposed along a circumference of the assembly section 12. The at least one pilot holes 122 can be disposed on the bottom of the assembly groove 121. The assembly groove 121 can be configured for inlaying the flexible snap ring 20, so that the fixable snap ring 20 can be stably connected to the lid body 10. In the present embodiment, a width of the assembly groove 121 can be greater than that of the pilot hole 122, so as to prevent damage or deformation of the flexible snap ring 20 caused by the part of the flexible snap ring 20 protruding from the pilot hole 122 to the center of the lid body 10.

In some embodiments, a bottom surface of the assembly section 12 can have a chamfer 123, so as to facilitate connecting the lid body 10 with the container body 200. It should be understood that in other embodiments, the chamfer 123 can be a round-shaped chamfer or a slope-shaped chamfer, as long as it facilitates the lid body protruding into the container body 200.

Figure 5:
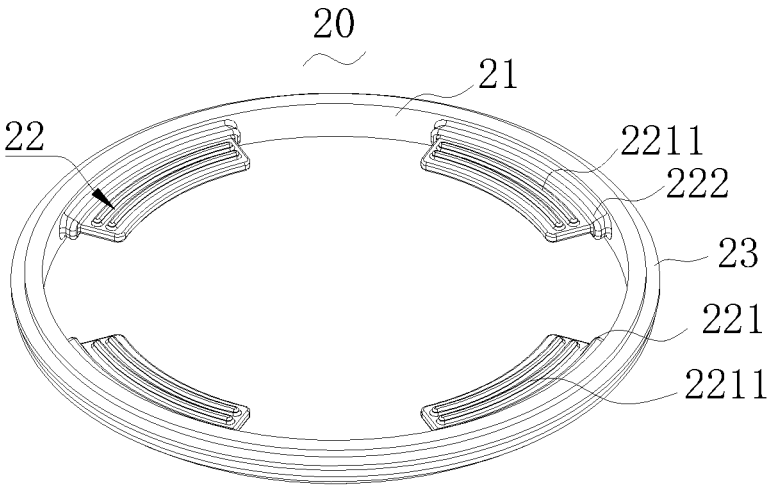
FIG. 5 a structural schematic view of a flexible snap ring of the container lid in FIG. 1.
Figure 6:
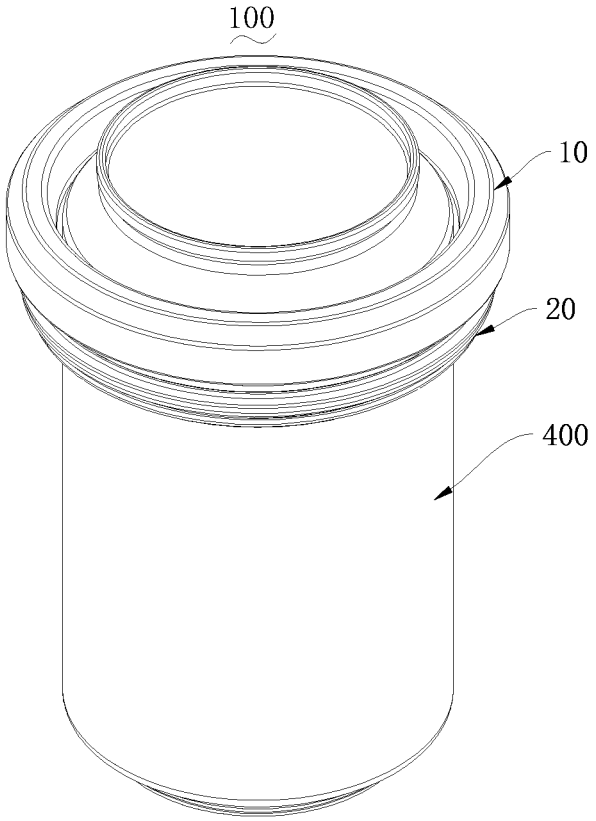
FIG. 6 a structural schematic view of the container lid in FIG. 1 when it is sleeved on a drink bottle.
Figure 7:
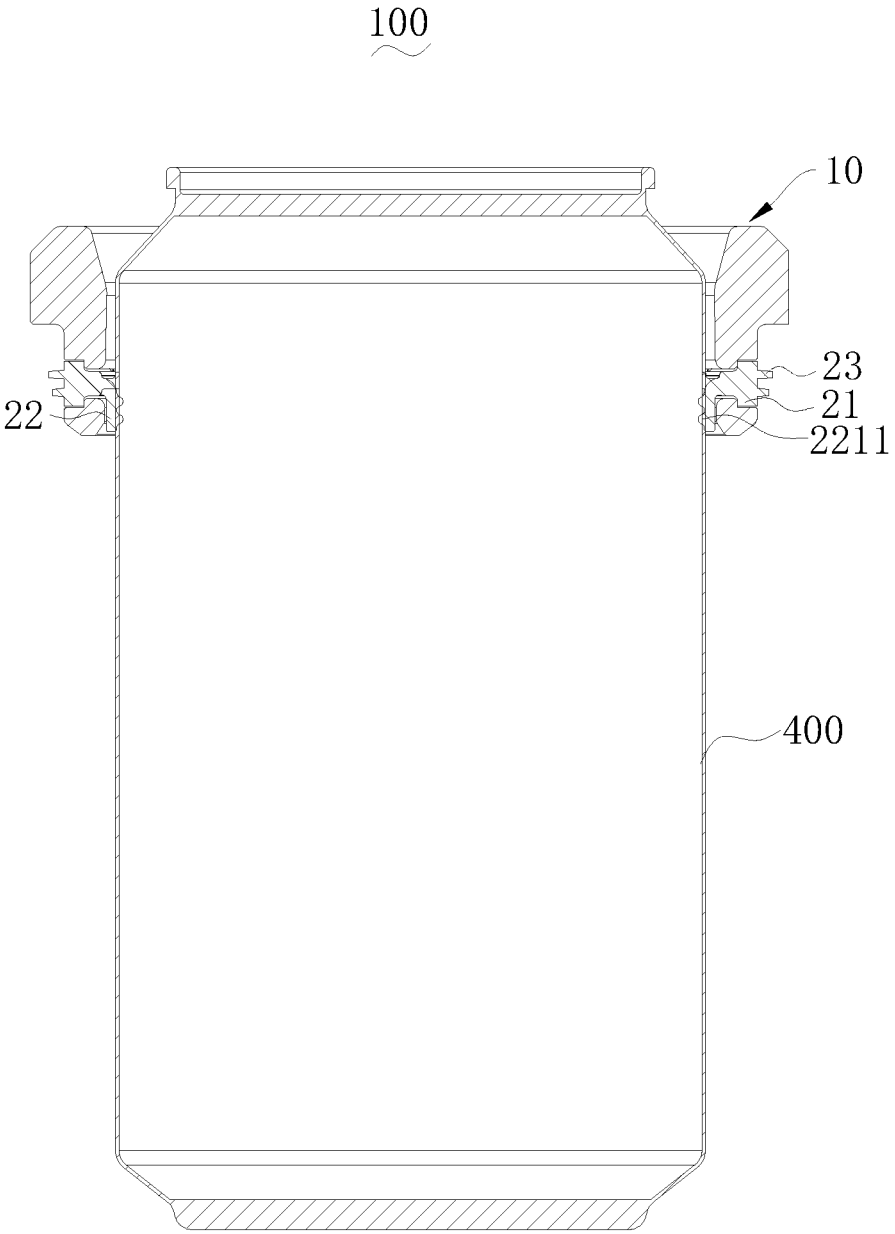
FIG. 7 is a cross-section view of the container lid and the drink bottle in FIG. 6.

FIG. 5 is a structural schematic view of a flexible snap ring 20 of the container lid 100 in FIG. 1, FIG. 6 is a structural schematic view of the container lid 100 in FIG. 1 when it is sleeved on a drink bottle 400, and FIG. 7 is a cross-section view of the container lid 100 and the drink bottle 400 in FIG. 6.

The flexible snap ring can be encircled around the assembly section 12. The flexible snap ring 20 can be mainly configured for sealing the container. When the lid body 10 covers on the container body 200, the flexible snap ring 20 can prevent the cold air or hot air in the container body 200 from emitting from a slot between the lid body 10 and the container body 200. In addition, the flexible snap ring 20 can further prevent the dust, etc., in the environment from entering the container body 200 from the slot between the lid body 10 and the container body 200, so as to avoid problems such as bacteria breeding, so that an user can use the container 300 safely and healthily.

The flexible snap ring 20 can substantially be in an annular shape, and have certain elasticity. The flexible snap ring 20 can include an assembly portion 21 and at least one clamping portion 22. The assembly portion 21 can substantially be in an annular shape. A part of an inner wall of flexible snap ring 20 can protrude towards the center of the lid body 10 and define the clamping portion 22. The assembly portion 21 can be encircled around an outer surface of the assembly section 12 and can be inlaid in the assembly groove 121. The at least one clamping portion can penetrate through the at least one pilot hole 122 from the outer surface of the assembly section 12, and protrude towards the center of the lid body 10.

The assembly portion 21 and the at least one clamping portion 22 are all made of elastic materials. Therefore, when the assembly portion 21 is inlaid in the assembly groove 121, the assembly portion 21 can have a tendency to hoop the inner wall of the assembly groove 121. Thus, the assembly portion 21 can be stably connected to the assembly section 12. Moreover, an end of the clamping portion 22 protruding towards the center of the lid body 10 can have certain elasticity. When the drink bottle is inserted in the container body 200, the at least one clamping portion 22 can be driven by the inserted drink bottle 400 to bend. Therefore, due to being elastically abutted against the at least one clamping portion 22, the drink bottle 400 can be stably accommodated in the container body 200.

In some embodiments, the at least one clamping portion 22 can be sector-shaped. A first end of the clamping portion 22 can be fixed to the inner wall of the assembly portion 21, and a second end of the clamping portion 22 can protrude into the lid body 10 through the pilot hole 122. The at least one clamping portion 22 can be configured for abutting against the outer surface of the drink bottle 400 when the drink bottle inserts in the container body 200. Therefore, the drink body 400 accommodated in the container body 200 is not easy to move, so that the user's experience can be improved. The sector-shaped clamping portion 22 can match with a cambered outer surface of the drink bottle.

It should be understood that the at least one clamping portion 22 can be in other shapes, for example shapes such as trapezoid, square sheets or protrudes, etc., as long as the at least one clamping portion 22 can abut against the drink bottle 400.

The at least one clamping portion 22 can include a first surface 221 and a second surface (not marked in the drawings). The first surface 221 and the second surface are in directions away from each other. The first surface 221 faces to a direction that the drink bottle inserts into the container body 200, and abuts against the outer surface of the drink bottle 400 when the at least one clamping portion 22 bends along a direction the drink bottle 400 inserting in the container body 200.

In some embodiments, the first surface 221 can include an antiskid portion 2211. The antiskid portion 2211 can be configured for abutting against the outer surface of the drink bottle 400, and increasing friction between the at least one clamping portion 22 and the drink bottle 400, so as to prevent the drink bottle 400 from sliding out from the container body 200.

Furthermore, the antiskid portion 2211 can be strip-shaped embossments disposed on the first surface 221. A number of the strip-shaped embossments can be two. The two strip-shaped embossments can be parallel to the inner edge of the clamping portion. Therefore, buckling resistance of the at least one clamping portion 22 will not be increased along with increased thickness of the at least one clamping portion 22 caused by the definition of the antiskid portion 2211. Moreover, friction between the at least one clamping portion 22 and the drink bottle can be further increased, so that the container lid 100 can be tightly sleeved on the drink bottle 400. It should be understood that in other embodiments, the antiskid portion 2211 can have other structures, such as uniformly disposed dots or dent antiskid figures, as long as it can increase the friction between the at least one clamping portion 22 and the drink bottle 400.

In some embodiments, the flexible snap ring 20 can include four clamping portions 22, and the four clamping portions 22 are uniformly disposed on an inner wall of the assembly portion 21 along a circumference of the assembly portion 21. Therefore, the four clamping portion 22 can uniformly abut against the drink bottle 400, so that the drink bottle 400 will not be easy to incline, thereby avoiding the liquid stored in the liquid bottle 400 to be poured out.

In some embodiments, a part of the at least one clamping portion at which connects with the assembly portion 21 can protrude towards the inner wall of the at least one pilot hole 122, and define a connection protrusion 222. The connecting protrusion 222 can be encircled around the outer surface of the at least one clamping portion 22, and can match with the at least one pilot hole 122.

In some embodiments, the at least one clamping portion 22 and the at least one pilot holes 122 can be interference fit, so that the at least one clamping portion 22 can be tightly inlaid in the at least one pilot holes 122, thereby avoiding the at least one clamping portion 22 to move in the at least one pilot holes 122 and preventing dirt from blocking in a slot between the at least one clamping portion 22 and the at least one pilot holes 122. It should be understood that in some embodiments, without regard to the mounting stability of the at least one clamping portion 22, the at least one clamping portion 22 may not have the connecting protrusion 222.

In the present embodiment, the flexible snap ring 20 can be integrated, i.e., the assembly portion 21, the at least one clamping portion 22 and other parts of the flexible snap ring 20 can be integrally formed. Therefore, the flexible snap ring 20 is convenient to produce and assemble. Since the at least one clamping portion 22 of the flexible snap ring 20 suffers from a plurality of times of bending, the assembly portion 21 and the at least one clamping portion which are integrally-formed can have better connecting strength.

In some embodiments, as the container lid 100 is a daily necessity for drinking, the flexible snap ring 20 can be made of food grade silica gel so as to ensure the container lid meeting sanitary requirements of daily necessities. It should be understood that the flexible snap ring 20 can be made of flexibly materials such as rubber at the like.

The present disclosure includes a container lid which has a flexible snap ring. Due to the flexible snap ring, a drink bottle sleeved by the container lid can be stably accommodated in the container body.

Figure 8:
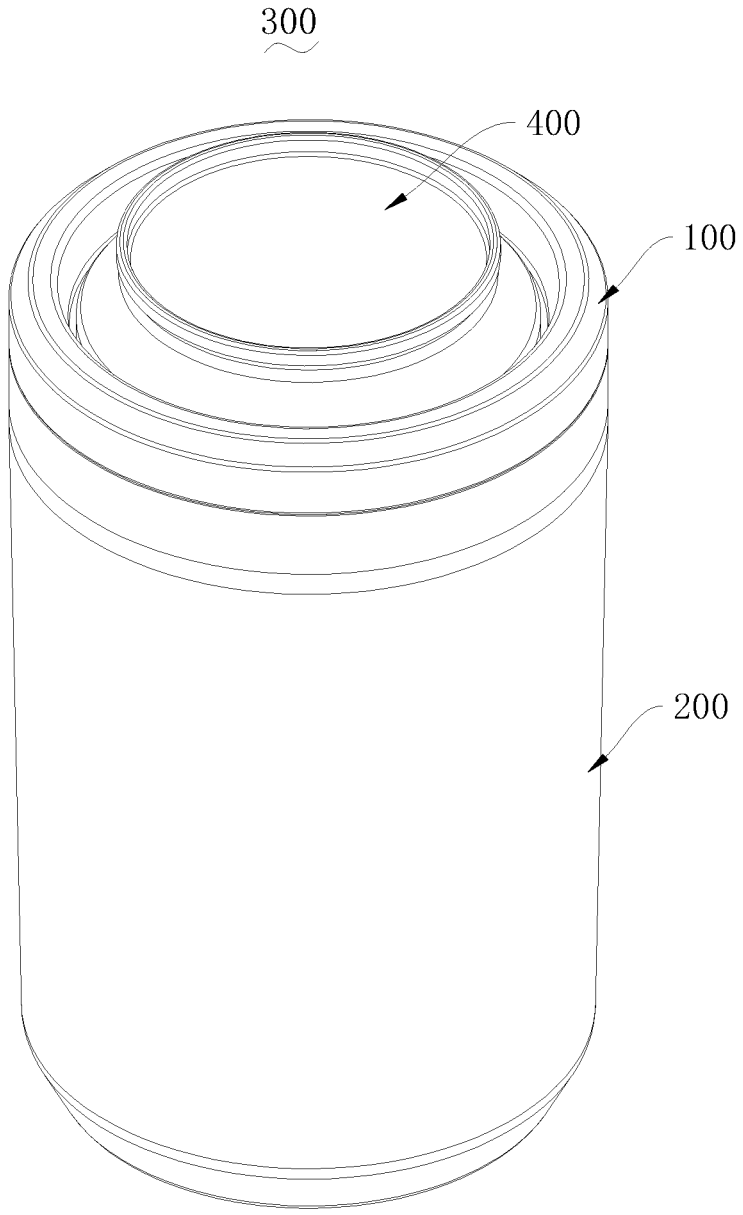
FIG. 8 is a structural schematic view of a container in an embodiment of the present disclosure when it accommodates the drink bottle.
Figure 9:
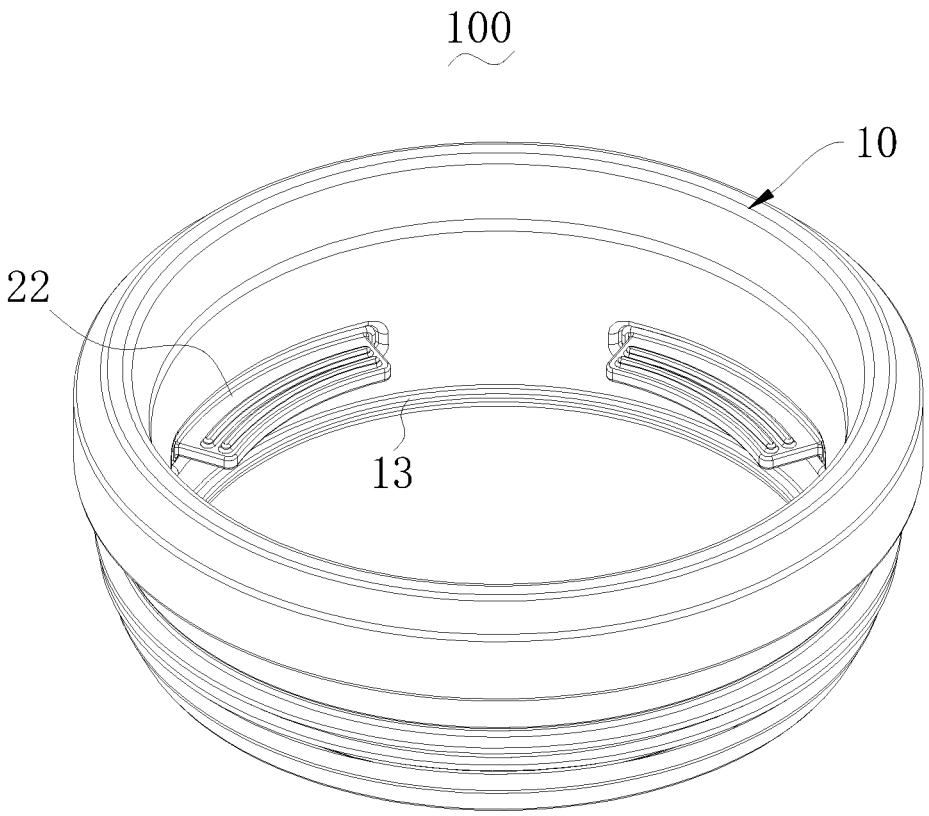
FIG. 9 is a structural schematic view of a container lid of another embodiment of the present disclosure.
Figure 10:
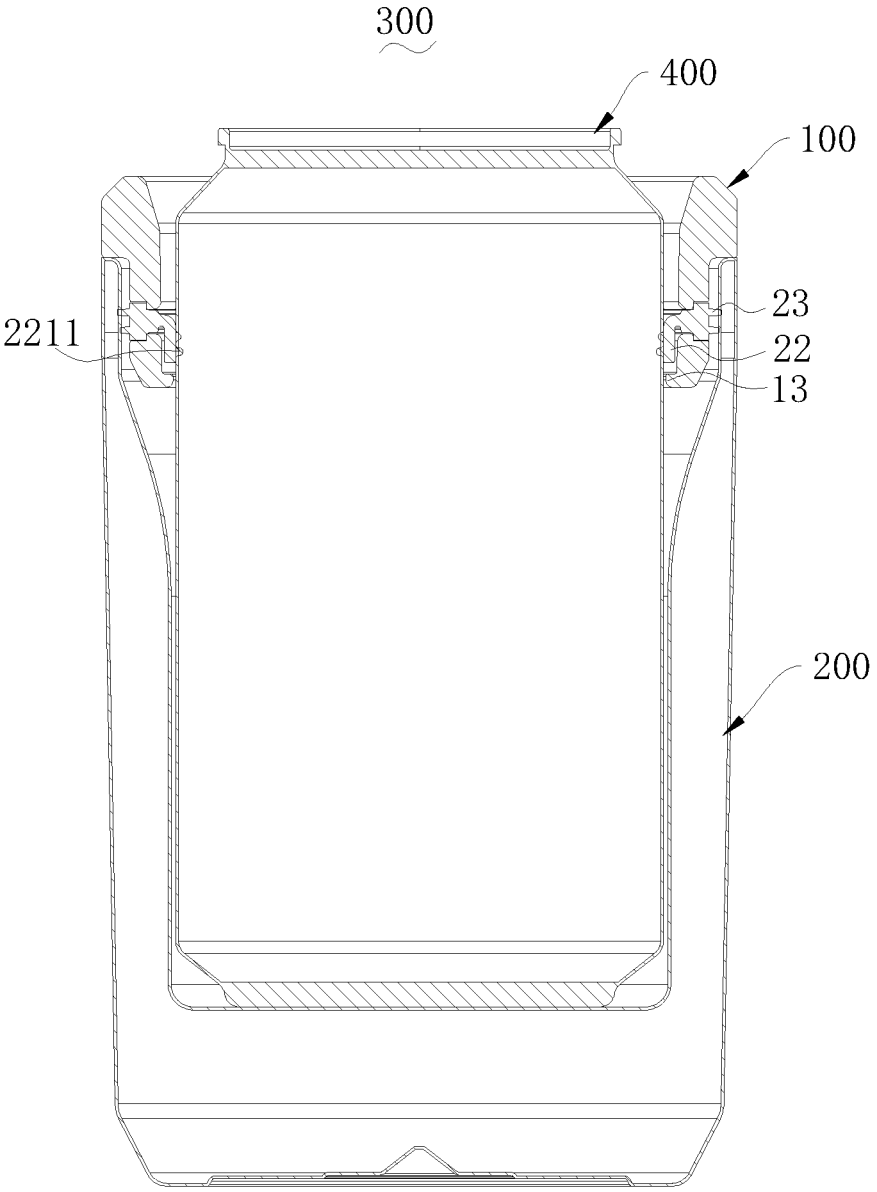
FIG. 10 is a cross section view of the container lid in FIG. 9 when it works together with a container body to accommodate a drink bottle.

FIG. 8 is a structural schematic view of a container in an embodiment of the present disclosure when it accommodates the drink bottle; FIG. 9 is a structural schematic view of a container lid of another embodiment of the present disclosure; FIG. 10 is a cross section view of the container lid in FIG. 9 when it works together with a container body to accommodate a drink bottle.

The present disclosure further includes a container 300, including the container lid 100 above and a container body 200. The container lid 100 can be covered on the container body 200.

In some embodiments, referring to FIG. 3 or FIG. 7, the lid body 10 of the container lid 100 can be sealingly connected to the opening of the container body 200 via the flexible snap ring 20. In some embodiments, the outer surface of the assembly portion 21 can protrude out along the radial direction of the cross section of the lid body 10 to define a sealing portion 23. The sealing portion 23 can be disposed along the circumference of the assembly portion 21, which can be configured for abutting against the inner wall of the container body 200 when the container lid 100 is covered on the container body 200.

In some embodiments, the sealing portion 23 can be flexible. When the container lid 100 is covered on the container body 200, the sealing portion 23 can be pressed, so that a slot between the container lid 100 and the container body 200 can be filled by the sealing portion 23.

In some embodiments, the lid body 10 is clamped with the container body 200 through the cooperation of the elastic assembly portion 21 and the sealing portion 23. It should be understood that in other embodiments, the lid body 10 can be directly clamped to or threadedly connected to the container body 200, and further sealingly connected to the container body 200 with the cooperation of the flexibly assembly portion 21 and the sealing portion 23.

Further, in order to increase the leakproofness and connection strength between the lid body 10, the flexible snap ring 20 and the container body 200, the number of the sealing portion 23 can be two. The two sealing portions 23 can be disposed parallel to the radial direction of the cross section of the lid body 10. It should be understood that in other embodiments, the sealing portion 23 can be one, or more than three, as long as the lid body 10 can be sealingly connected to the container body 200.

In some embodiments, when the drink bottle 400 inserts into the container body 200, the at least one clamping portion 22 can deform and abut against the drink bottle 400. If the at least one clamping portion 22 is tensible, the drink bottle 400 can drive the at least one clamping portion 22 towards the bottom of the container body 200 after the at least one clamping portion 22 deform. The at least one clamping portion 22 can be easy to break if it is incorrectly used. Therefore, referring to FIG. 9 and FIG. 10, at least a part of the lid body 10 can be extended along the radial direction of the cross section of the lid body 10 and define a limiting portion 13. The limiting portion 13 can be disposed on a route along which the clamping portion 22 deforms after the drink bottle 400 is inserted in the container body 200. The limiting portion 13 can prevent the at least one clamping portion 22 from being excessively stretched under the effect of the drink bottle 400, so that the extending and deformation of the at least one clamping portion 22 can be controlled in a certain range, thereby extending the service life of the at least one clamping portion 22.

In the present embodiment, a lower part of the assembly section 12 of the lid body 10 can be extended along the radial direction of the cross section of the lid body 10 to define an annulus-shaped limiting portion 13. The limiting portion 13 can be an annulus-shaped convex rib disposed on the inner wall of the assembly section 12. Therefore, being excessively stretched of the at least one clamping portion 22 relative to the lid body 10 can be effectively prevented. Whether the drink bottle 400 drives the at least one clamping portion 22 to stretch directly below or stretches in other oblique directions, the annulus-shaped limiting portion 13 can prevent the at least one clamping portion 22 from being excessively stretched.

It should be understood that the limiting portion 13 can be in other shapes. For example, the limiting portion 13 can be convex lines disposed at intervals, and disposed right below the at least one pilot holes 122, as long as it can prevent the at least one clamping portion 22 from being excessively stretched. Moreover, the limiting portion can be disposed at positions according to actual need.

As shown in FIG. 8, the container body 200 can be roughly a cup body, which can accommodate and cover a part of the drink bottle. In some embodiments, the container body 200 can be a vacuum cup. Therefore, the liquid in the drink bottle 400 accommodated in the container 300 can be pretty well insulated from the external environment, so that a temperature of the liquid can be kept stable for a longer time. For example, in summer, cool drinks, beer in the drink bottle 400 can stay cool for a long period of time, and the hand of the user does not have to touch with a cold and wet outer surface of the drink bottle 400.

It should be understood that the container body can have a single-deck cup structure in some embodiments.

In some embodiments, an inner wall of the container body 200 can include a screw thread or a neck, which can be configured for being threadedly connecting with or clamped to the lid body 10.

In some embodiments, liquid can be directly added in the container body 200. The user can drink the liquid in the container body 200 without covering the container lid 100, or drink the liquid after covering the container lid 100 on the lid body 200.

The present disclosure can further include a container, which can be configured for accommodating a drink bottle.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A container lid for sleeving on a drink bottle, the container lid comprising an annulus-shaped lid body and a flexible snap ring, and the lid body comprises at least one pilot hole, which penetrates through the lid body, wherein the flexible snap ring comprises an assembly portion and at least one clamping portion, wherein the assembly portion encircles around an outer surface of the lid body, and a part of the flexible snap ring is extended along a radial direction of a cross section of the lid body to define the at least one clamping portion, and the at least one clamping portion is capable of penetrating through the at least one pilot hole from the outer surface of the lid body, and abutting against an outer surface of the drink bottle.

2. The container lid of claim 1, wherein the at least one clamping portion comprises a first surface, the first surface faces a direction that the drink bottle inserts into a container, and abuts against the outer surface of the drink bottle when the clamping portion is bent.

3. The container lid of claim 2, wherein the first surface comprises an antiskid portion, and the antiskid portion is configured for abutting against the outer surface of the drink bottle.

4. The container lid of claim 1, wherein the flexible snap ring comprises four clamping portions, and the lid body comprises four pilot holes accordingly, and the four clamping portions are uniformly disposed on an inner wall of the assembly portion along a circumference of the assembly portion.

5. The container lid of claim 1, wherein a connecting protrusion is configured for connecting the at least one clamping portion with the assembly portion, and the connecting protrusion matches with the at least one pilot hole.

6. The container lid of claim 1, wherein an assembly groove is disposed on the outer surface of the lid body, the assembly portion is inlaid in the assembly groove, and the at least one pilot hole is located at a bottom of the assembly groove.

7. The container lid of claim 1, wherein at least a part of the lid body is extended along the radial direction of the cross section of the lid body and defines a limiting portion, and the limiting portion is disposed on a route along which the at least one clamping portion deforms.

8. The container lid of claim 7, wherein the limiting portion is disposed at a bottom of the lid body.

9. The container lid of claim 7, wherein the limiting portion is annulus-shaped.

10. A container, comprising a container body and a container lid covering the container body, wherein the container lid comprises an annulus-shaped lid body and a flexible snap ring, and the lid body comprises at least one pilot hole, which penetrates through the lid body, wherein the flexible snap ring comprises an assembly portion and at least one clamping portion, wherein the assembly portion encircles around an outer surface of the lid body, and a part of the flexible snap ring is extended along a radial direction of a cross section of the lid body to define the at least one clamping portion, and the at least one clamping portion is capable of penetrating through the at least one pilot hole from the outer surface of the lid body, and abutting against an outer surface of the container body.

11. The container of claim 10, wherein the container body comprises a vacuum cup body.

12. The container of claim 10, wherein the lid body is configured for clamping the container body.

13. The container of claim 12, wherein two sealing portions parallel to each other, and are encircled around the assembly portion.

14. The container of claim 10, wherein the outer surface of the assembly portion protrudes out along the radial direction of the cross section of the lid body to define at least one sealing portion, which is configured for abutting against an inner wall of the container body, so that the lid body is sealingly connected to the container body.

* * * * *